United States Patent [19]

Clark

[11] 4,139,079

[45] Feb. 13, 1979

[54] FLEXIBLE STILE OR ROPE LADDER FOR CLIMBING POLES OR LIKE MEMBERS

[76] Inventor: Trevor Clark, 2 Cove Pl., Whitehall Beach, R.F.D. #5, Box 234C, Annapolis, Md. 21401

[21] Appl. No.: 890,022

[22] Filed: Mar. 24, 1978

[51] Int. Cl.[2] ..... E06C 1/56; E06C 9/14

[52] U.S. Cl. ..... 182/93; 182/70; 182/100; 182/189; 182/195; 182/198

[58] Field of Search ..... 182/93, 100, 195, 196, 182/197, 198, 82, 142, 70

[56] References Cited

U.S. PATENT DOCUMENTS

| | | | |
|---|---|---|---|
| 271,802 | 2/1883 | Craigie | 182/93 |
| 321,385 | 6/1885 | Pyne | 182/196 |
| 701,483 | 6/1902 | Hemming | 182/93 |
| 1,010,526 | 12/1911 | Stanley | 182/70 |
| 3,999,627 | 12/1976 | Naka | 182/100 |
| 4,014,057 | 3/1977 | Kuojarvi | 182/196 |

*Primary Examiner*—Reinaldo P. Machado
*Attorney, Agent, or Firm*—Scrivener, Parker, Scrivener & Clarke

[57] ABSTRACT

A flexible stile ladder is disclosed wherein the midpoints of the ladder steps or rungs are slidably connected to the pole. Preferably, the slidable connectors are slides which operate in a track carried by the pole. The invention is particularly useful for climbing masts of sailboats.

16 Claims, 15 Drawing Figures

FIG. 12.
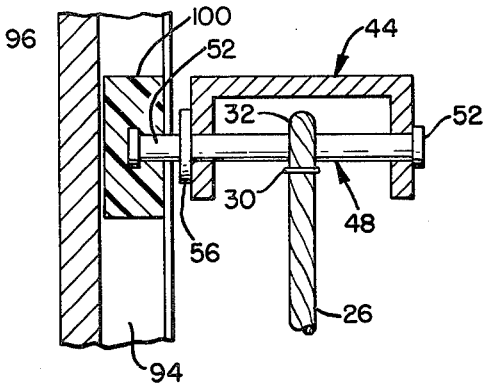
FIG. 13.
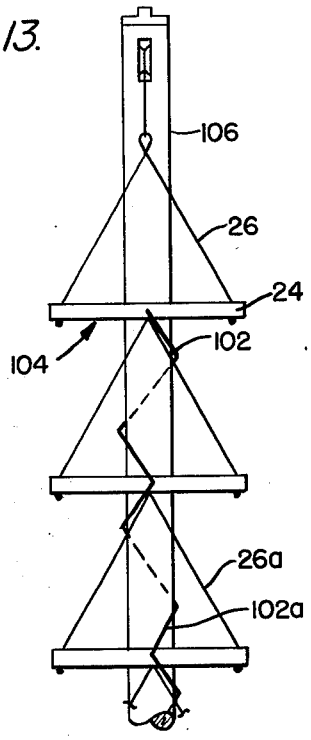
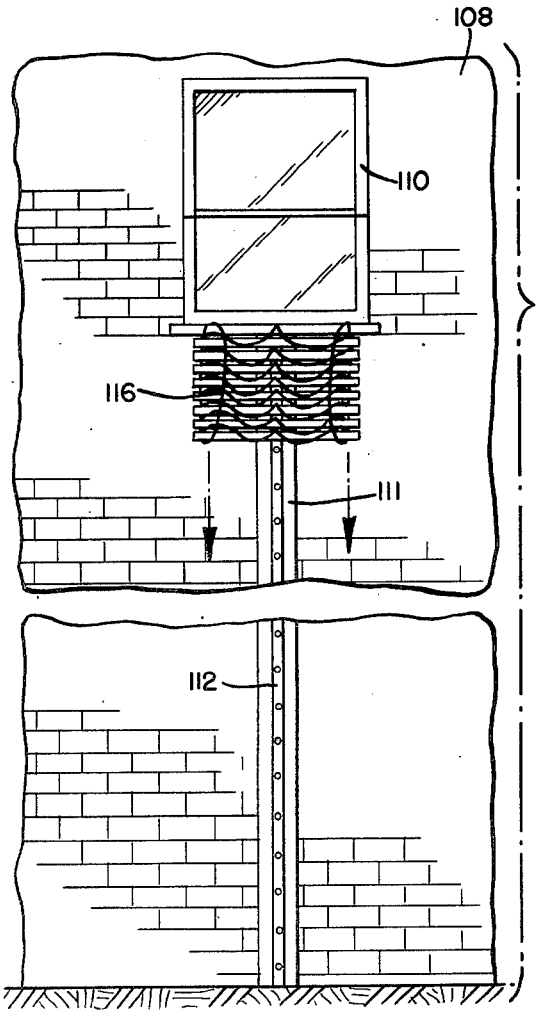
FIG. 14.
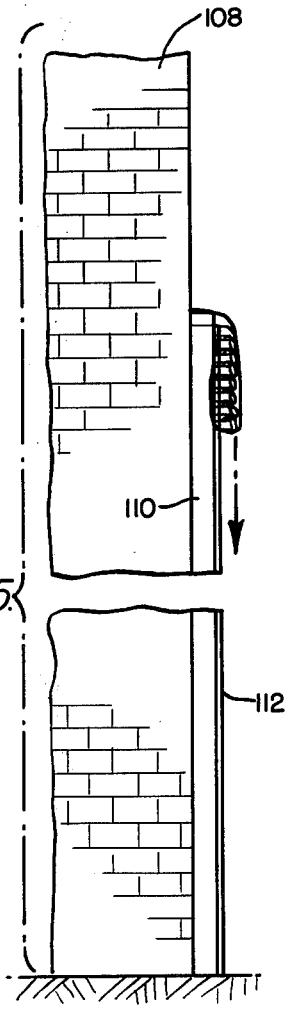
FIG. 15.

FLEXIBLE STILE OR ROPE LADDER FOR CLIMBING POLES OR LIKE MEMBERS

This invention relates to ladders and more particularly to flexible stile or rope ladders especially, though not exclusively, suited to climbing vertical poles or like members, particularly sailboat masts.

The ladder of the present invention, while it has other uses as will be described hereinafter, is particularly suited to climbing sailboat masts. Heretofore when it has been necessary for a person to ascend a mast not equipped with in situ climbing facilities, such as ratlines, it has been the almost universal practice to employ a bosun's chair, which is a seat adapted to be attached to a sail halyard and raised, with a person seated thereon, by operation of a halyard winch located in a convenient position near the base of the mast.

Though bosun's chairs are quite satisfactory, there is the problem that they always require at least one additional person of sufficient physical strength of operate the winch at deck level. Obviously, where the manpower for operating the winch is not available and an individual must ascend the mast, he cannot do so by use of a bosun's chair and the alternatives are to physically climb the mast or to use some form of ladder. A conventional rigid ladder, if it is long enough, would be satisfactory but these are seldom available and can never be carried aboard a moderate sized vessel. A rope ladder, while susceptible of convenient stowage on a relatively small vessel, is unsatisfactory and in fact dangerous for use in climbing masts. The rungs of a rope ladder have only point contact with a mast and the unbalanced weight of a climber causes the rung on which his feet are supported to be moved hard against the mast at a single fulcrum point while the rung grasped by the hand is pulled a substantial distance away from the mast without there being any lateral support for the ladder of any kind. Thus, when the climber lifts one foot from a rung for climbing purposes, the other foot still on the rung on the other side of the fulcrum point causes that rung to swivel suddenly around the mast with the distinct possibility that the climber will be thrown off. In addition, if there is any kind of wave action an ordinary rope ladder will swing uncontrollably like a pendulum with the possibility that the climber will be injured by being swung against the mast. This problem seldom occurs with bosun's chairs since the individual is seated on the chair and thus his hands and legs are free to grasp the mast should the boat be subjected to unexpected wave action. For the foregoing reasons ordinary rope ladders are seldom if ever employed for climbing sailboat masts.

The broad object of the present invention is to adapt a flexible stile or rope ladder for use in climbing sailboat masts or similar structures through the expedient of securing to the midpoint of all or some of the steps or rungs of the ladder means for slidably connecting the midpoints of the rungs to the mast in such a manner that the rungs are restrained against undue lateral movement from any source such as wave action or the unbalanced weight of the climber.

More particularly, it is an object of the invention to provide a flexible stile ladder of the foregoing nature wherein the means for connecting the midpoint of some or all of the ladder rungs to the mast or other structure comprise slides which cooperate with vertical track means carried by the mast. The slides and track being identical and, so far as the track is concerned, the same, as the slides and track employed for raising and lowering a sail.

Though the majority of masts are provided with some form of track, there are still some masts which are not and the present invention encompasses the use of a rope or flexible stile ladder constructed in accordance with the invention which can be used with masts having no track at all.

A subsidiary object of the invention is to provide a ladder of the general type described which, in one embodiment, includes means whereby the slide carried by a rung can be engaged over a track without necessarily starting at the lower most end of the track, thus enabling the ladder to be positioned for use above a doused sail already occupying the lower part of the track. This feature can be important when one must go up a mast during a sailboat race but where the hanking of a large mainsail off and on a track in order to permit the use of the ladder would consume an inordinate amount of time.

Yet another object of the invention is to provide a flexible stile ladder utilizing the described track and slide feature for purposes of a fire escape or for climbing structures where it would be dangerous for permanent climbing means to be available to the general public.

The foregoing and still other objects of the invention will become apparent as the following detailed description is read in conjunction with the accompanying drawings wherein:

FIG. 12 is a vertical cross sectional view taken substantially on the line 12—12 of FIG. 11;

FIG. 13 is the broken elevational view of a ladder constructed in accordance with the invention but adapted for use with a mast having no track at all;

FIG. 14 is a broken, front elevational view of a building showing a ladder constructed in accordance with the invention triced up in readiness for use as a fire escape; and FIG. 15 is a side elevational view of the arrangement of FIG. 14.

Figure 1:
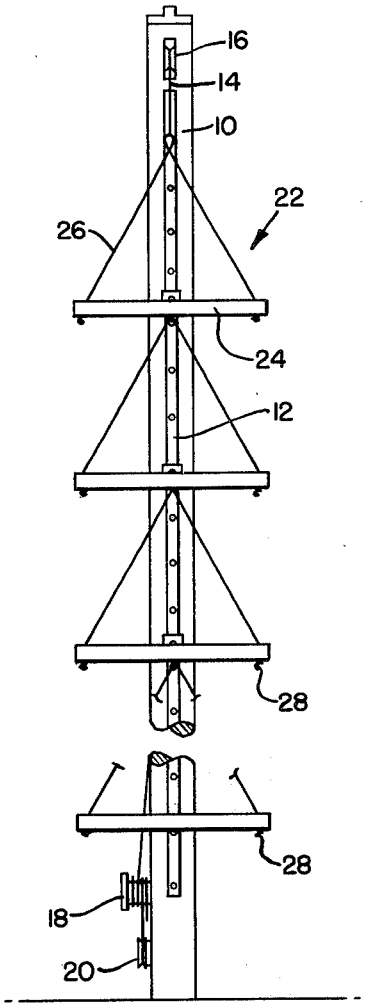
FIG. 1 is a broken, vertical elevational view of a mast showing a ladder constructed in accordance with the invention suspended from a sail halyard.

Referring now to the drawings wherein like numbers refer to like parts throughout, and with particular attention to FIG. 1, the numeral 10 designates a sailboat mast carrying a track 12 which, in normal use, is slidably engaged by slides secured to the luff of a sail which is controlled for raising or lowering by means of a halyard 14 operating over a sheave 16 at the top of the mast and leading to a halyard winch 18 near the lower end of the mast. The winch may be of the type wherein the halyard is stored on the winch drum or it may be of the type wherein the winch receives several turns of the halyard which is then secured to a cleat 20 when the sail is raised to its proper height.

As can be seen the ladder of the invention, broadly designated by the numeral 22, comprises a series of steps or rungs 24 each of which, except for the upper most one, is attached to the rung above it by a rope part 26 whose ends are connected to the opposed ends of the rung and whose bight is attached to the midpoint of the rung above.

Figure 2:
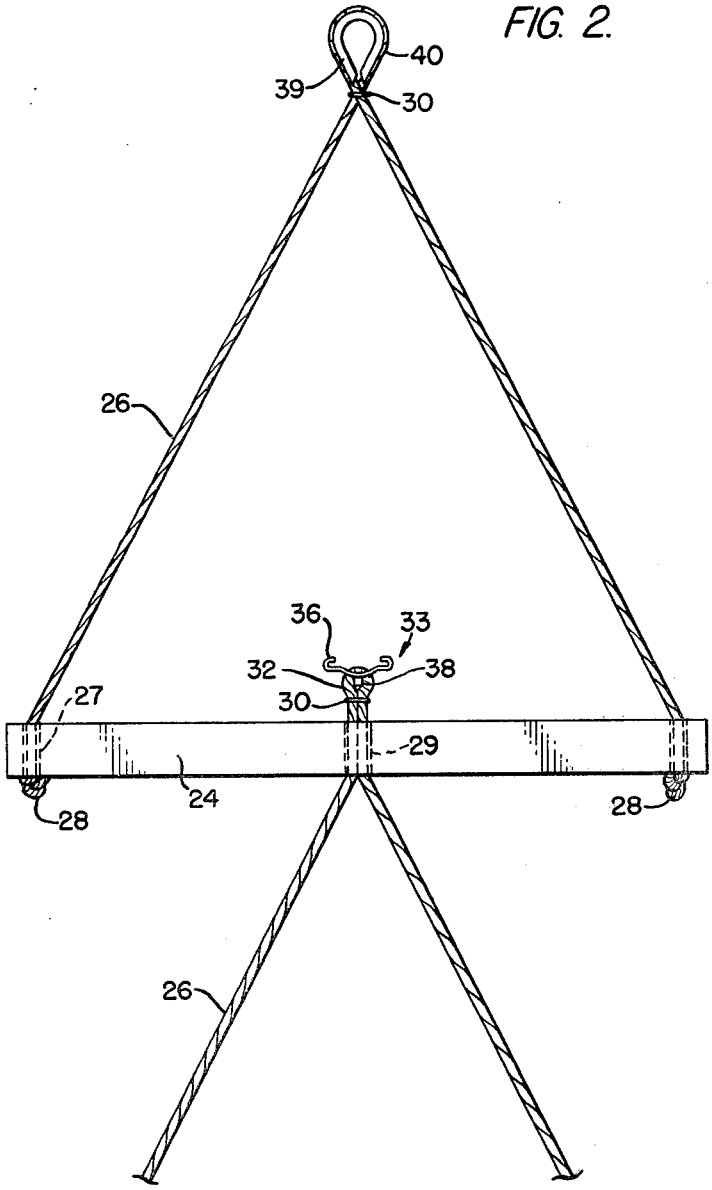
FIG. 2 is an enlarged detail view of the topmost step of the ladder of the present invention.

Referring now to FIG. 2, it will be observed that the ends of a rope part 26 extend through holes 27 in the rung ends and are conveniently retained in place by stopper knots 28. The midpoint of each rung is drilled to define a hole 29 which receives therethrough the bight of the rope part 26 of the rung below, with the two adjacent sides of the projecting bight being connected together by a clamping ring 30, well known in the art, to define an eye 32 at the extremity of the bight to which a conventional sail slide 33 is attached.

A conventional sail slide of the type shown has flanged arms 36 for engaging the sides of an external track such as the track 12 shown in FIG. 1. Such slides have a rearwardly extending bail 38 parallel to the flanged arms and formed by a pressing operation. This bail is used to fasten the slide to a cringle along the luff of the sail. A bail 38 of a slide suitable for use on a moderate size sailboat of about 30 feet can usually accomodate a quarterinch Dacron (trademark Dupont de Nemoures Company) or polypropelene line of which the rope parts 26 are desirably composed. Where the rope part can pass through the slide bail, it will be apparent in FIG. 2 that the end of the rope part is first threaded through the central opening 29 in the rung then passed through the bail of the slide and passed back through the rung opening and after the rope part has been adjusted so that both legs are of approximately equal length, the clamping ring 30 is engaged and thereafter the ends of the rope part pushed through the openings 27 at the opposed ends of the next lower rung and the stopper knots are tied therein as will be clear from FIG. 2. Should the slide bails not be large enough to accomodate the rope part in the manner just described, then the slide bails can be connected to the rope eye by means of small shackles or by lashing.

As can be seen in FIG. 2, the bight on the uppermost rope part is trained around a thimble 39 and the adjacent parts of the bight below the thimble are joined together by a clamping ring 30 or by lashing to form an eye 40. Eye 40 defines the means for suspending the ladder from a sail halyard or other elevated support.

In use of the embodiment of FIG. 2, a sail, if present on the track, is unhanked from the track and the slides 33 are hanked on to the track in the usual manner after the sail halyard shackle (not shown) has been engaged with the eye 40. The bights containing the slides easily bend to a position at substantially right angles to the position shown in FIG. 2 as each slide is engaged with the lower end of the track. The ladder is hauled up to the desired height by hand or by operation of the halyard winch 18 and when raised to the desired elevation, the halyard is secured either by locking the winch or by being wrapped around the winch and then secured to the cleat 20 whereupon a user can readily ascend and descend the mast as he requires.

Figure 3:
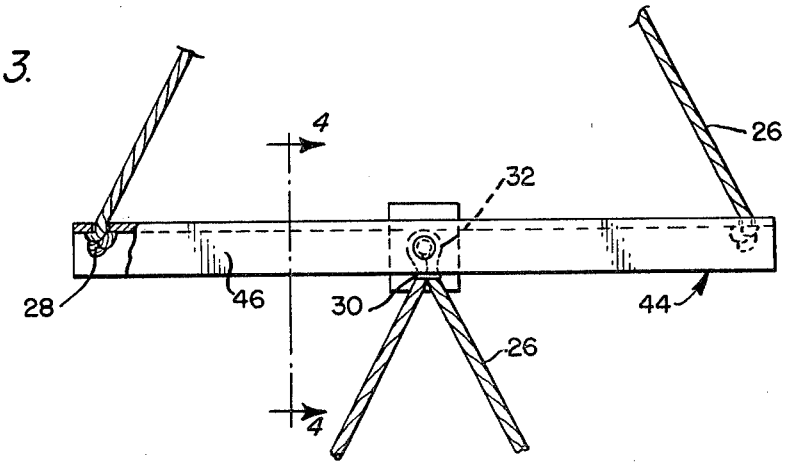
FIG. 3 is a broken view similar to FIG. 2 showing a second embodiment of the invention.
Figure 4:
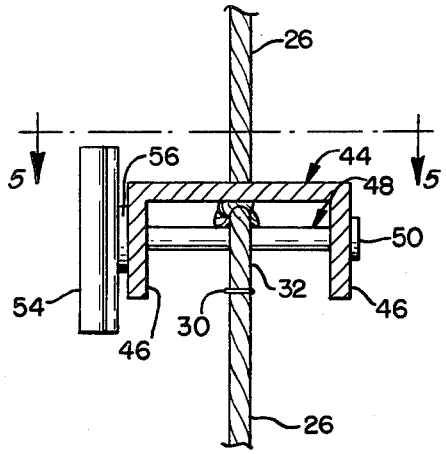
FIG. 4 is an enlarged cross sectional view taken substantially on the line 4—4 of FIG. 3.
Figure 5:
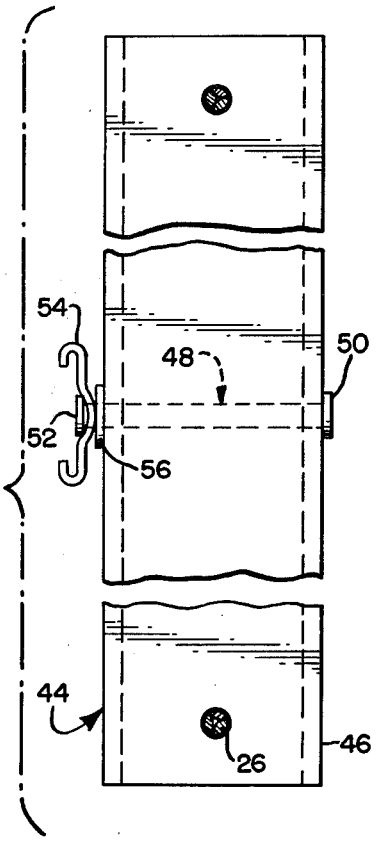
FIG. 5 is a broken horizontal plan view taken substantially on the line 5—5 of FIG. 4.

The embodiment of FIGS. 3, 4 and 5 is generally similar to FIG. 2 except that each ring 44 is channel shaped and preferably of metal or molded high-strength plastic. Each rung has longitudinally extending side parts 46 through the midpoints of which extends a horizontal fastening element 48 having a head 50 at one end and projecting at the other end 52 beyond the side to receive a slide 54 which may be the same as the slide 33 shown in FIG. 2 except that the slide 54 lacks a bail 38 and instead has a substantially flat, apertured back through which the projecting end 52 of the fastening element 48 extends and is peened over to retain the slide in place, a washer 56 being interposed between the rear of the slide and the side of the rung. With this arrangement, the slide is freely rotatable on the fastening element in order to facilitate engagement of the slides with the track. It will be observed in FIG. 4 that a central part of the fastening element 48 is exposed between the longitudinal sides of the rung and receives an eye 32 formed in the bight of the rope part 26 by a clamping ring 30 exactly as in the embodiment of FIG. 2. As with FIG. 2, the end of each rope part 26 is retained in the opposed ends of its rung by stopper knots 28.

Figure 6:
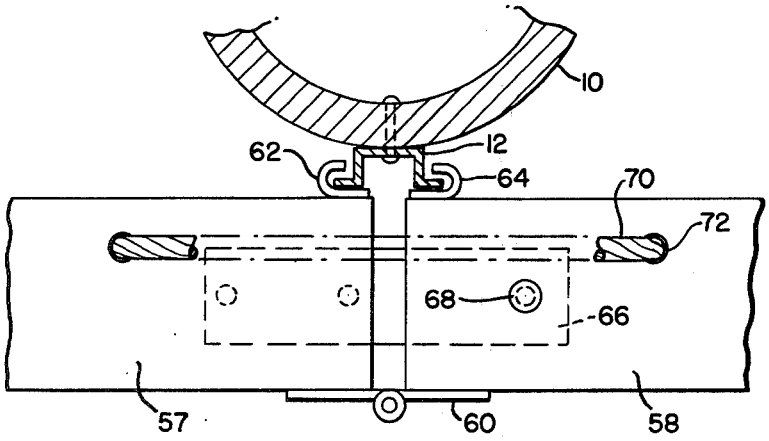
FIG. 6 is a broken plan view of a third embodiment of the invention.
Figure 7:
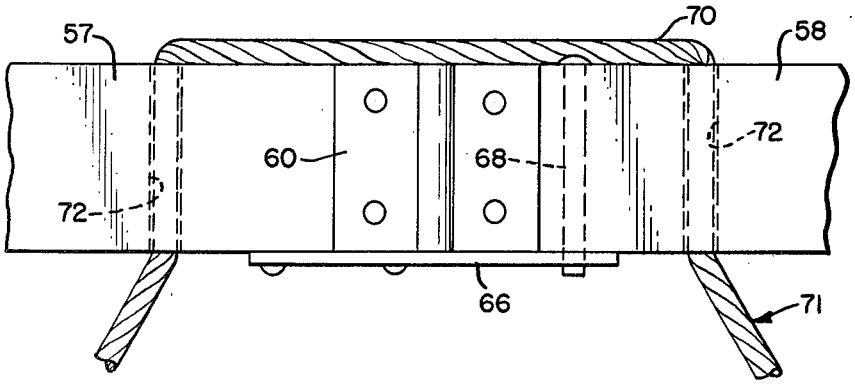
FIG. 7 is a broken elevational view of the embodiment of FIG. 6.

The embodiment of FIGS. 6 and 7 is generally similar to that of the embodiment just described except that each rung or step is made in two halves 57, 58 connected at their adjacent ends by a hinge 60 which is arranged to constrain the rung halves to movement in a horizontal plane between angular and aligned positions. The sides of the rung halves 57, 58 opposite the hinge 60 each carries a slide half 62, 64, respectively, positioned that when the rung halves are moved to an aligned position, the slide halves define a unitary slide for cooperation with an external track 12 fixed to the mast 10. Releasable fastening means rigidly connect the rung halves in aligned position, the fastening means comprising, for example, a latch plate 66 fixed to one of the rung halves, say 57, and having an aperture at its free end which aligns with an opening through the other rung half 58 to receive a locking pin 68 which rigidly connects the halves together when aligned. When the pin is removed, the rung halves can be swung to a relative angular position and readily disengaged from the track 12. As can be seen, the bight 70 of the rope part 71 extends through vertical openings 72 in the respective rung halves and it will be observed that the openings are positioned relative to the pivot axis of the hinge 60 that weight on a rung below tends to close the slide parts 62, 64 on to the track 12 so that even if a pin 68 should be missing or the latch plate fail, the rung would not become accidentally detached from the track.

Figure 8:
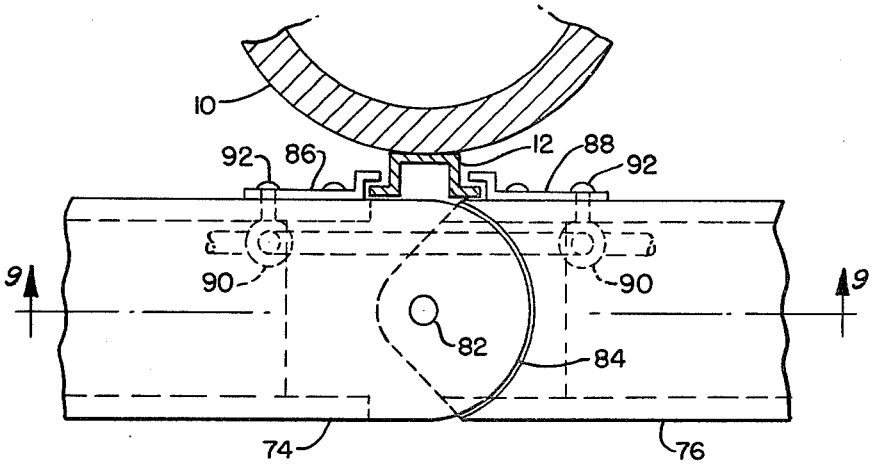
FIG. 8 is a view similar to FIG. 6 but showing a fourth embodiment of the invention.
Figure 9:
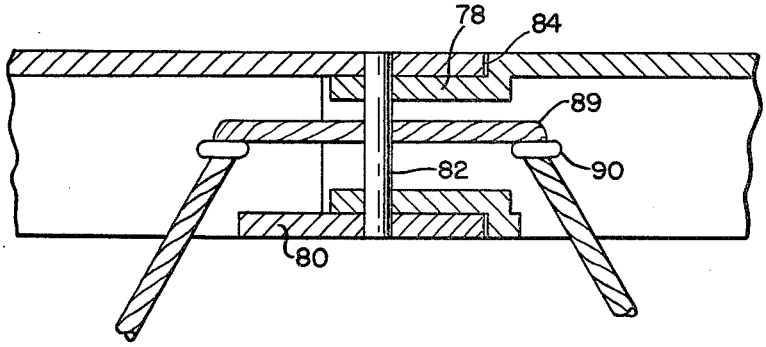
FIG. 9 is a vertical cross sectional view of the embodiment of FIG. 8 taken substantially on the line 9—9 of FIG. 8.

The arrangement of FIGS. 8 and 9 is somewhat similar to that of FIGS. 6 and 7 in that each rung is formed in two halves 74, 76 one of the halves, say 76, having a stepped tongue part 78 which is received in a socketed end part 80 of the other half. The tongue and socket parts are drilled to receive a vertical hinge pin 82 and the confronting end faces 84 are radiused to enable the halves to be swung between aligned and angular positions. Riveted to the front faces of the two halves adjacent the hinge line are slide halves 86, 88 which, in the aligned position of the halves, define a complete slide engageable with the track 12. In the arrangement of FIGS. 8 and 9 no latch of any kind is provided, the halves being retained in aligned position by the operation of the bight 89 of the rope part threaded through eyes 90, which may conveniently be integral with one set of rivets 92 which also fasten the slide parts to the rung halves. As is clear in FIG. 8, the eyes 90 are on the mast side of the pivot axis of the pin 82 so that the weight of a climber causes the bight of the rope parts to act on the rung halves in such a manner as to cause the slide parts 86, 88 to close on to the track 12. Once closed, the friction of the rope bight in the eyes will retain the slide parts closed even when a climber's weight is removed from lower rungs, though it is a simple task to manipulate the bight in the reverse direction sufficient to permit the ready disengagement of the slide parts from the track when climbing operations are completed.

Figure 10:
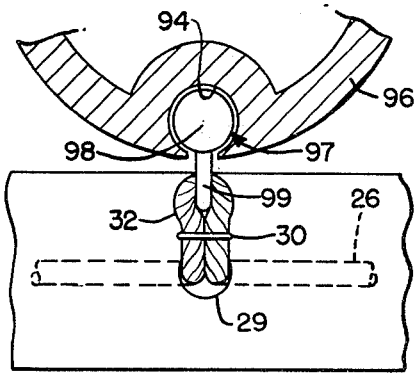
FIG. 10 is a horizontal cross sectional view of a mast equipped with an integral groove for the reception of an internal sail slide wich may be employed with the invention.

FIG. 10 illustrates the adaptation of the invention to an internal slide which cooperates with an internal track 94 formed in the mast 96. The slide 97 is a conventional sail slide having a cylindrical body 98, usually of nylon, and projecting from one side of the body is a metallic bail 99 for attachment to the luff cringles of a sail. When used with the present invention and a rung of the type shown in FIG. 2, one end of the line part is first threaded through the central opening 29 in the rung 24, then through the bail 99 of the slide, and back through the opening 29 to the opposite end of the rung below. As in the arrangement of FIG. 2, the adjacent parts of the extreme end of the bight of the line part are bound together by a clamp ring 30 as shown or by suitable lashing.

Figure 11:
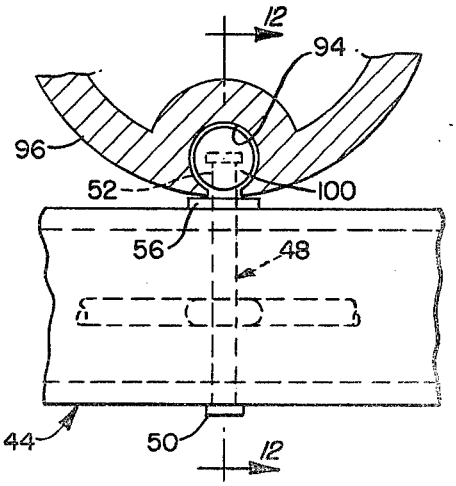
FIG. 11 is a view similar to FIG. 1 but showing an internal sail slide adapted for use with a rung construction of the type shown in FIG.'s 3, 4 and 5.

FIGS. 11 and 12 illustrate the adaptation of the arrangement of FIGS. 3–5 to an internal slide. In this embodiment, the projecting end 52 of the pin 48 is moulded into the body of the slide 100 as should be clear in FIGS. 11 and 12. Otherwise, the arrangement of FIGS. 11 and 12 is the same as in FIGS. 3–5.

FIG. 13 illustrates an arrangement wherein the ladder of the invention is adapted for use with a mast having no tracks. It is known to lash sails to masts by a lace line in a manner which permits the sail to be readily raised and lowered by its halyard, an operation which would be substantially impossible if the lace line were merely to spiral around the mast, passing through the sail luff cringles. Instead of spiraling, a lace line is arranged in a substantially zig-zag fashion as shown in FIG. 13 wherein a lace line 102 is arranged similar to that used for sails but in this case is used for slidably connecting a ladder 104, constructed in accordance with the invention, to a trackless mast 106. As can be seen, the upper end of the lace line is connected to the midpoint of the uppermost rung 24. From here the lace line is wrapped around the mast to the midpoint of the next rung below but instead now of the lace line continuing in the same direction around the mast, its direction of wrap is reversed until the midpoint of the next lower rung is reached whereupon the direction of wrap is reversed again, and so on for each of the rungs for the full length of the ladder.

With the ladder 104 laced to the mast in the manner just described, it is secured to the mast almost as effectively as when it depends on slides and tracks. Observing the middle rung of the three shown in FIG. 13, it will be seen that the lace line would apparently permit the middle rung to move laterally to the left. However, the rung is restrained from such movement by the lower right-hand leg **26*a* of the rope part of the next rung below, that leg acting as a guy leading from the end of the rung below which itself is prevented from moving to the left by the lace line part 102*a* as is clearly apparent in FIG. 13**. Thus, not only is the ladder secured against lateral movement to the mast but at the same time it can be readily raised and lowered in the same manner as sails similarly laced.

FIGS. 14 and 15 illustrate the ladder of the invention adapted to fire escape use. Though it is an old expedient to store a rope ladder near elevated emergency exits to serve as a fire escape, the usual rope ladder is dangerous to use for a variety of reasons. For example, when the ladder hangs freely close to a building wall, the climber's weight causes a hand held rung to pull away from the wall while a foot engaged rung moves toward the wall usually abutting it and possibly pushing the climber's projecting toe part of his foot entirely off the rung. Also, if the ladder is initially abutting the wall, as is usually the case, it is extremely difficult to obtain a toe hold on a rung. If the ladder is suspended from an outrigger support so that it is entirely clear of the building wall, not only is the ladder difficult to graps, but climbing a freely hanging rope ladder is an extremely difficult and risky task because of the unbalanced weight of the climber. The present invention eliminates these problems and with reference to FIG. 14, the numeral 108 designates a building having an elevated emergency exit such as the window 110 shown. Extending from below the window sill to the ground or other place of escape is a vertical support member 111 carrying on its outer face a track 112 which may be similar to any of the tracks described hereinbefore in connection with masts. Slidably engaged with the track are mating slides of the type suited thereto with each of the slides being connected to the midpoint of a ladder rung, the rungs being connected to each other by flexible stiles, as for example, by the individual rope parts in a manner described hereinbefore, with all parts of the ladder being fireproof, as for example, wire stiles and metal rungs.

When not in use, the ladder is triced up in a collapsed position below the windowsill by the use of quick release ties 116, the upper end of the ladder being permanently strongly connected to the building just below the sill. In the event of an emergency, the exit is opened, and the quick release ties removed whereupon the ladder drops to its extended position with the slides being guided by the track. The vertical support 111 is selected so that the face thereof carrying the track is spaced sufficiently from the surface of the building wall that a climber's foot has ample room to stand on each rung without interference from the building. The arrangement of the invention not only stabilizes the ladder so that it is more easily negotiated by inexperienced climbers than a conventional rope ladder, but it also vastly improves over ordinary rope ladders the changes that a climber will safely reach the ground or other place of escape without slipping from the ladder due to engagement of his foot with the building wall.

The basic concept of the invention of providing slides at the midpoint of rungs of flexible stile ladders applies both to conventional rope ladders and to ladders having the construction described herein. A ladder construction utilizing individual rope parts between adjacent rungs as described herein has a number of advantages. Among these, is the fact that the rungs are positively secured to the stiles. In ordinary rope ladders, there is difficulty in securely fastening the rungs to the stiles and the rungs can slip or tilt unexpectedly relative to the stiles. Another important feature is that with the construction of the invention, it is a relatively simple matter to "add-on" rungs to increase the length of the ladder at will, as where one obtains a boat having a higher mast than his previous boat, or where the purchaser desires to have the ladder made-up by a chandler to suit the height of his mast.

In addition to climbing masts, it has been shown how the ladder of the invention utilizing the described slide and track arrangement is susceptible for use as a fire escape. And though an external track has been shown in the drawings, this clearly could be a grooved member for use with internal slides.

The ladder of the invention has other uses than those described. For example, where it may be necessary to ascend a structure from time to time yet where the general public must be excluded, the structure may be equipped with tracks and means, such as a halyard, for raising such a ladder in the track when it is desired to climb the structure. Simple means for latching the top most rung and remotely releasing the rung may be included but are not required. Legs of water towers, windmills or other elevated structures are ideal applications for such ladders.

A particular advantage of the ladder of the invention is its light weight and portability. An inspector or serviceman can carry such a ladder in a small bundle within a vehicle without requiring the use of a rigid ladder lashed to the outside of the vehicle. If the structure to be inspected or serviced is equipped with a track and halyard means, it is a simple matter to erect the ladder and to remove it for transportation. The permanently installed track on the structure affords substantially no opportunity for unauthorized use so that permanent climbing means possibly creating an attractive nuisance of a structure can be entirely eliminated.

Preferred embodiments of the invention have been described. However, it will be apparent to those skilled in the art, that the invention is susceptible of a variety of changes and modifications without, however, departing from the scope and spirit of the appended claims.

What is claimed is:

1. A ladder assembly for ascending and descending a vertical pole or like member comprising a plurality of step means, stile means interconnecting said steps in spaced relationship, means for slidably connecting the midpoint of at least some of said step means to said vertical pole or like member, and means at one end of said assembly for vertically suspending the same from the upper end of said vertical pole or like member.

2. The ladder assembly of claim 1 wherein each of said step means comprises a rigid rung, said stile means being flexible and being connected to the opposite ends of said rung.

3. The ladder assembly of claim 1 wherein said means for slidably connecting at least some of said steps to said pole or like member comprises slide means adapted to cooperate with track means carried by said vertical pole or like member.

4. The ladder assembly of claim 3 wherein each of said step means comprises a rigid rung, said stile means being connected to opposed ends of said rungs, each of said slide means comprising a unitary slide, and means connecting each of said slides to the midpoint of its rung.

5. The ladder assembly of claim 2 wherein the stile means comprises a plurality of flexible rope parts one for each rung, the ends of each rope part being connected to the respective opposed ends of a rung, and means connecting the midpoint of the bight of each rope part to the midpoint of the next rung thereabove.

6. The ladder assembly of claim 5 wherein the bight of the rope part connected to the ends of the uppermost rung defines an eye, said eye comprising said suspension means.

7. The ladder assembly of claim 3 wherein the stile means comprises a plurality of rope parts, one for each rung, the ends of each rope part being connected to the respective opposed ends of a rung, each of said rungs having a central aperture there through, the bight of the rope part connected to the next rung below extending through said aperture and projecting beyond the opposite side of said rung, said slide for said rung being attached to the projecting bight of said rope part.

8. The ladder assembly of claim 2 wherein the flexible stile means comprises a plurality of rope parts, one for each rung, the ends of each rope part being connected to the respective opposed ends of a rung, means connecting together two points of each rope part on opposite sides of the midpoint of the bight thereof to define an eye, and means for connecting the eye of each rope part of a rung to the midpoint of the rung above except for the uppermost rung, the eye of the uppermost rung comprising the means for suspending said assembly.

9. The ladder assembly of claim 8 wherein said means for slidably connecting at least some of said rungs to said pole or like member comprises a unitary slide, an aperture extending through the midpoint of each rung, the eye of the rope part of one rung projecting through and beyond the aperture in the next rung, and means connecting said unitary slide to the projecting eye of said rope part, said slide comprising the means for connecting each eye to its respective rung.

10. The ladder assembly of claim 8 wherein said means for slidably connecting at least some of said rungs to said pole or like member comprises a unitary slide, a fastening element extending laterally through opposed longitudinal sides of each rung, said rung being constructed and arranged that a portion of said fastening element is exposed between the longitudinal sides of said rung, the eye of a rope part of one rung being received on the exposed portion of the fastening element of the next rung, an end of each of said fastening elements projecting beyond a side of its respective rung, and means rotatably connecting said unitary slide to the projecting end of said fastening element.

11. The ladder assembly of claim 1 wherein each of said step means comprises halves hingedly joined at the center of the rung, the two halves being movable in a horizontal plane between angular and aligned positions, said means for slidably connecting the midpoint of at least some of said rungs to said vertical pole or like member comprising a slide part on each half of said rung positioned that when said halves are moved to an aligned position said slide parts define a unitary slide for cooperation with a track on said vertical pole or like member, and when said halves of said rung are moved to their angular position said slide parts move apart to enable said slide to be disengaged from a track, and releasable fastening means for rigidly connecting the halves together when in their aligned position.

12. The ladder assembly of claim 11 wherein said releasable fastening means comprises a latch plate fixed to one of the halves, and releasable pin means carried by the other half and engageable with said latch plate when the halves are in aligned position to retain said halves in said position.

13. The ladder assembly of claim 11 wherein said stile means comprises a plurality of flexible rope parts, the ends of each rope part being connected to the respective opposed ends of a rung, the bight of each rope part extending through apertures in the respective halves of the next rung above adjacent the hinged ends thereof, the apertures being located relative to the hinge axis that the weight of a climber on the rung below tends to force said halves to their aligned position, said apertures and said rope parts comprising the releasable fastening means.

14. The ladder assembly of claim 4 wherein each slide is adapted to cooperate with an external track fixed to a vertical pole or like member.

15. The ladder assembly of claim 4 wherein each slide is adapted to cooperate with an internal groove of a vertical pole or like member.

16. In combination with the ladder assembly of claim 2, a building, a vertical support extending from an elevated exit from the building parallel to the side thereof, track means fixed to said support, said support spacing said track means from the side of said building, said means for slidably connecting the midpoint of at least some of said rungs to said track means comprising unitary slides engaging said track means, means fixed to said building adjacent said exit engaging said suspending means, and releasable means retaining said ladder in a collapsed condition adjacent said exit, said releasable means being releasable in an emergency to permit said ladder to move by gravity to an extended position with said slides guided by said track means, the spacing of said track means by said support from the side of the building being of a size to permit the foot of a user of the ladder to be spaced from the side of the building during an emergency descent.

* * * * *